United States Patent [19]

Takeuji et al.

[11] Patent Number: 4,812,617

[45] Date of Patent: Mar. 14, 1989

[54] COOLING SYSTEM FOR COOLING ELECTRICAL PARTS FOR MICROWAVE OVEN

[75] Inventors: Koichi Takeuji, Kitakatsuragi; Takashi Furusawa, Nara, both of Japan

[73] Assignee: Sharp Kabushiki Kaisha, Osaka, Japan

[21] Appl. No.: 451,254

[22] Filed: Dec. 20, 1982

Related U.S. Application Data

[63] Continuation of Ser. No. 343,902, Jan. 29, 1982, abandoned, which is a continuation of Ser. No. 127,850, Mar. 6, 1980, abandoned.

[30] Foreign Application Priority Data

Mar. 6, 1979 [JP] Japan ..... 54-28804[U]

[51] Int. Cl.[4] ..... H05B 6/80

[52] U.S. Cl. ..... 219/10.55 R; 219/10.55 B; 219/400; 126/198

[58] Field of Search ..... 219/10.55 R, 10.55 B, 219/10.55 D, 400; 174/16 R, 15 R, 35 R; 361/383, 384; 165/135, 59; 126/198

[56] References Cited

U.S. PATENT DOCUMENTS 3,654,417 4/1972 Javes et al. ..... 219/10.55 R
4,123,643 10/1978 Burke ..... 219/10.55 R
4,184,945 1/1980 Morgan et al. ..... 219/10.55 R X
4,221,949 9/1980 Minakawa ..... 219/10.55 R X
4,327,274 4/1982 White et al. ..... 219/10.55 R

FOREIGN PATENT DOCUMENTS 54-14039 2/1979 Japan ..... 219/10.55 R

*Primary Examiner*—Philip H. Leung
*Attorney, Agent, or Firm*—Birch, Stewart, Kolasch & Birch

[57] ABSTRACT

A microwave oven comprises a screen plate covering a high voltage transformer positioned on the bottom of an outer housing. An inlet window is formed in the bottom between the screen plate and the high voltage transformer. An air duct is produced in a gap between the screen plate and the high voltage transformer. The screen plate carries at least one electric component. A printed circuit board supporting a plurality of circuit elements such as a semiconductor chip, etc., is separated from the high voltage transformer by the screen plate. In addition to the high voltage transformer, the screen plate containing the electrical component disposed thereon is cooled by air flowing through the air duct, the air being circulated with the help of a cooling blower. The air also serves to cool a magnetron operated to control the microwave oven.

6 Claims, 2 Drawing Sheets

COOLING SYSTEM FOR COOLING ELECTRICAL PARTS FOR MICROWAVE OVEN

This application is a continuation of copending application Ser. No. 343,902, filed on Jan. 29, 1982, which is a continuation of Ser. No. 127,850, filed on Mar. 6, 1980, both abandoned.

BACKGROUND OF THE INVENTION

The present invention relates to a microwave oven and, more particularly, to a cooling system for cooling some electrical parts operable for a microwave oven.

Recently, a semiconductor chip has been incorporated within a heating appliance such as a microwave oven. The semiconductor chip is adapted to control the heating appliance as shown in T. Kawabata et al, Ser. No. 792,222, "Microwave Oven with a Programmable Digital Control Circuit" filed on Apr. 29, 1977. The semiconductor chip has a tendency to be easily damaged by heat evolved within the housing of the heating appliance. When heat adversely affects to the semiconductor chip the heating appliance will become mismanaged.

OBJECTS AND SUMMARY OF THE INVENTION

Accordingly, it is a primary object of the present invention to provide a novel cooling system for a microwave oven.

It is another object of the present invention to provide a novel screen plate for a semiconductor chip included within a microwave oven.

A further object of the present invention is to provide a novel cooling system for a microwave oven for cooling some of the electrical components thereof, such as a high voltage transformer operable for energizing the microwave oven.

Still another object of the present invention is to provide a novel air guide member for applied to a microwave oven for cooling some of the electrical components thereof such as a high voltage transformer and circuit elements carried on the air guide member.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a microwave oven comprises a screen plate covering a high voltage transformer positioned on the bottom of an outer housing. An inlet window is formed in the bottom between the screen plate and the high voltage transformer. An air duct is produced in a gap between the screen plate and the high voltage transformer. The screen plate carries at least one electrical component. A printed circuit board supporting a plurality of circuit elements such as a semiconductor chip, etc., is spaced apart from the high voltage transformer by the screen plate.

In addition to the high voltage transformer, the screen plate having the electric component is cooled by an air flowing through the air duct, the air being circulated with the help of a cooling blower. The air can serve to cool a magnetron which is operated to control the microwave oven.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE INVENTION

Figure 1:
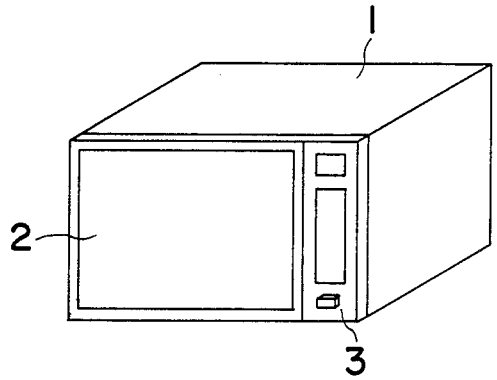
FIG. 1 is a perspective view of a microwave oven of the present invention.

With reference to FIG. 1, a microwave oven of the present invention comprises a cabinet 1, a oven door 2, and a control panel 3.

The control panel 3 may contain a plurality of key switches and a display. The plurality of key switches are actuated to enter desired cooking program information according to which the microwave oven is energized to provide microwave energy. Cooking time data of the cooking program information are indicated on the display. The cooling system which is the crux of the present invention is positioned behind the control panel 3.

Figure 2:
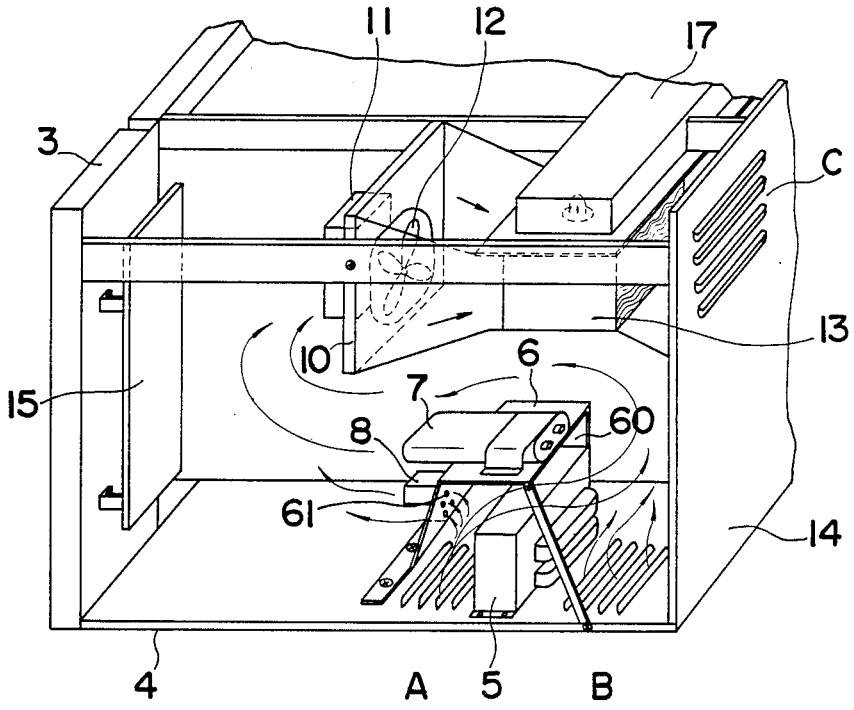
FIG. 2 is a perspective view of the cooling system for of the microwave oven shown in FIG. 1, the cabinet housing being omitted to more clearly show the interior arranged in the cooling system of the microwave oven.

FIG. 2 shows a perspective view of the cooling system adapted to the microwave oven according to the present invention. There are provided the control panel 3, a bottom wall 4, a high voltage transformer 5, an air guide 6, a high voltage condenser 7, a diode 8, a blower duct 10, a blower motor 11, a fan 12, a magnetron 13, a rear wall 14, a printed circuit board 15, a wave guide 17 and a passing hole 61.

The high voltage transformer 5 is carried on the bottom wall 4. In the bottom wall 4 adjacent the bottom of the high voltage transformer 5, there are formed two inlet windows A and B through which a certain amount of air is aspirated. Each of the high voltage transformer 5, the high voltage condenser 7, and the diode 8 generates very large quantities of heat when operated to activate the microwave oven. The air guide 6 is supported by the bottom wall 4 in such a manner that it covers a considerable part of the high voltage transformer 5. Since the air guide 6 is shaped in a substantial L-letter form, it confronts at least two sides of the high voltage transformer 5.

The air guide 6 is arranged so that an air passing through the inlet window A flows along the air guide 6, with the result that each of the high voltage transformer 5 and the air guide 6 is cooled. The air guide 6 is made of metal which is a good conductor. On the surface of the air guide 6 opposed to the high voltage transformer 5, there are held the high voltage condenser 7 and the diode 8. As the air guide 6 itself is cooled by the air flow passing the gap between the air guide 6 and the high voltage transformer 5, the high voltage condenser 7 and the diode 8 are both cooled.

Above the high voltage condenser 7, there is disposed the blower duct 10 containing the fan 12 which is driven by the blower motor 11 to provide a flow of air for cooling electrical parts of the microwave oven.

The blower duct 10 is coupled to a cooling fin box for the magnetron 13 so that air can pass the magnetron 13 for the purpose of cooling it the air is then discharged through an outlet window C formed in the rear wall 14. A gap portion 60 in the gap between the air guide 6 and the high voltage transformer 5 is disposed in an inverse direction the position of the fan 12 of the inlet window for the blower duct 10.

The printed circuit board 15 is separated from the high voltage transformer 5 by the air guide 6. Accordingly, it is protected from a very large quantities of heat which is evolved from the high voltage transformer 5. Although the high voltage condenser 7 also emits a considerable quantity of heat, it is cooled with the help of the air guide 6.

If it is fear that a flow of heated air may near the printed circuit board 15, the flow of air containing a considerable amount of heat from the high voltage transformer 5, the high voltage condenser 7, and the diode 8, with the result that the printed circuit board 15 is may be damaged. Thus it is preferable that the printed circuit board 15 is appropriately separated from this flow of air.

Figure 3:
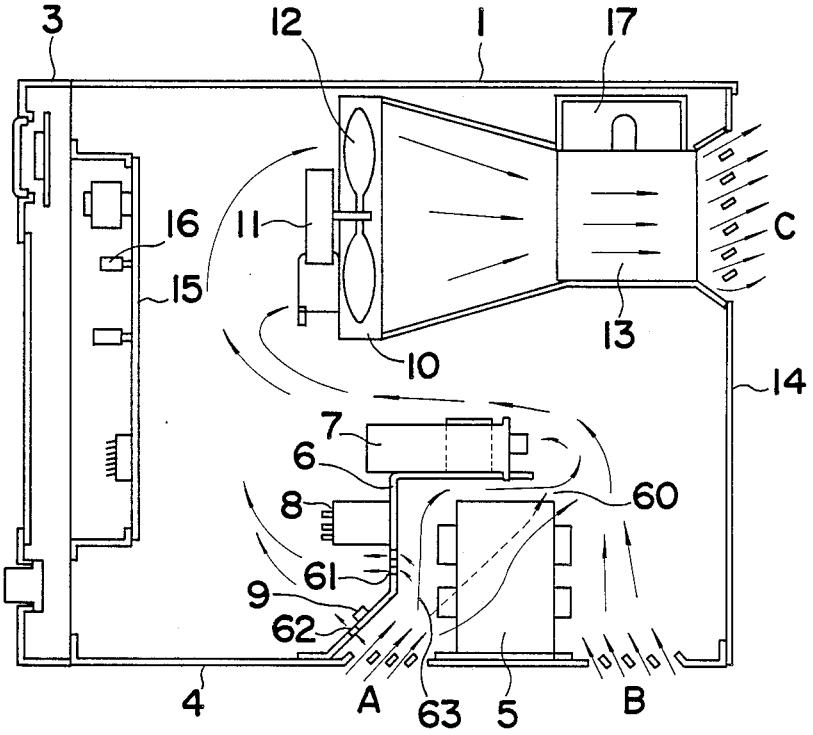
FIG. 3 is a sectional view of the cooling system depicted in FIG. 2.

FIG. 3 shows a sectional view of the cooling system depicted in FIG. 2. Elements corresponding to those of FIG. 2 are indicated by like numerals.

With reference to FIG. 3, there are further shown a plurality of circuit elements 16, a fuse holder 9, another passing hole 62 and flow air 63 in addition to the various members depicted in FIG. 2.

The plurality of circuit elements 16 include a large scale integrated (LSI) semiconductor chip, a condenser, and a resistor etc. Major parts of the circuit elements 16 are carried on the surface of the printed circuit board 15 on and opposite side to that of the high voltage transformer 5. Therefore, they are isolated from a large quantities of heat generated by the high voltage transformer 5, the high voltage condenser 7, and the diode 8.

The two passing holes 61 and 62 are formed in the air guide 6 so that a certain part of air flowing through the gap between the high voltage transformer 5 and the air guide 6 can pass therethrough. A main stream of air flowing through the gap is represented by the numeral 63. The fuse holder 9 contains a fuse.

In terms of the arrangement of the cooling system of the present invention, the blower motor 11 is operated to produce a flow of air as indicated by a segment of a line with an arrow head. The main stream of air 63 passes through the inlet window A and flows through the gap between the high voltage transformer 5 and the air guide 6 to cool them. The main stream of air 63 eventually reaches the gap portion 60.

After traveling through the gap portion 60 the air flow is mixed with another flow of air entering through the inlet window B. At this point, the flow of air is twisted at about 180° toward the fan 12. The flow of air is conducted along the high voltage condenser 7 toward the fan 12 to cool the high voltage condenser 7. Through the two passing holes 61 and 62, a certain amount of air flows near the diode 8 and the fuse holder 9 to cool them.

As the air guide 6 is cooled by the main stream of air 63, the high voltage condenser 7 and the diode 8 carried on the air guide 6 are accordingly cooled. The air guide 6 serves as a radiator for the high voltage condenser 7 and the diode 8.

While only certain embodiments of the present invention have been described, it will be apparent to those skilled in the art that various changes and modifications may be made therein without departing from the spirit and scope of the invention as claimed.

What is claimed is:

1. A microwave oven containing an air cooling system for electronic components disposed therein comprising:

an outer housing;

a magnetron and a transformer, which generate high temperature heat when actuated, said magnetron being positioned within said outer housing and said transformer being positioned on a part of said outer housing;

a fan means for circulating air within said outer housing;

ventilation means formed in the outer housing on opposite sides of said transformer, for obliquely drawing cooling air into said housing toward and around the transformer, said fan means drawing air through said ventilation means for cooling the opposite sides of said transformer, and said magnetron being exposed to air circulated by said fan means, and screen plate disposed adjacent the ventilation means on one side of the transformer, said screen plate means extending from said outer housing toward the transformer for further directing cooling air toward the transformer on one side thereof.

2. The microwave oven of claim 1 wherein the ventilation means are louvers disposed in the wall of the outer housing, said louvers being canted toward the transformer.

3. The microwave oven according to claim 1, wherein said screen plate is made of material possessing good thermal conductivity.

4. A microwave oven containing an air cooling system for electronic elements disposed therein which comprises:

an outer housing;

a magnetron and a transformer which generate high temperature heat when actuated, disposed in said housing;

a fan means operatively associated with said magnetron for circulating air within said outer housing and for cooling said magnetron;

a wiring board containing at least one electronic component disposed in said housing;

screen plate means containing at least one electrical element disposed thereon and positioned to separate the transformer from both the wiring board and the magnetron, said screen plate means extending from said outer housing toward the transformer for directing cooling air toward the transformer on one side thereof, ventilation means disposed in the wall of said outer housing between said screen plate means and said transformer on one side thereof and adjacent said transformer on the other side thereof for obliquely directing cooling air into said housing toward the transformer, whereby ambient air is drawn by said fan means between said screen plate means and said transformer on one side thereof and adjacent the transformer on the other side thereof to directly cool said screen plate means and said transformer and indirectly cool said at least one electrical element disposed on said screen plate and said air is further circulated to directly cool said at least one electrical element disposed on the screen plate means.

5. The microwave oven of claim 4 wherein the screen plate means comprising a substantially L-shaped configuration extending in one direction from the outer housing between the wiring board and the transformer and in a second direction between the magnetron and the transformer thereby defining an air duct between said screen plate means and said transformer whereby the ambient air drawn through said ventilation means cools the screen plate, surrounds and cools the transformer, diectly cools the electrical elements disposed on the screen plate and is circulated by said fan means to the magnetron.

6. The microwave oven of claim 4 wherein the screen plate means contains a plurality of holes.

* * * * *